US005615616A

United States Patent [19]

Scheuchzer et al.

[11] Patent Number: 5,615,616

[45] Date of Patent: Apr. 1, 1997

[54] PROCESS FOR SCREWING AND UNSCREWING THE TIE SCREWS OF A RAILROAD AND MACHINE FOR IMPLEMENTING THE PROCESS

[75] Inventors: Antoine Scheuchzer, Epalinges; Gérard Schelling, La Conversion; Christian Wenger, Bussigny-Pres-Lausanne; Gérard Sauterel, Fribourg, all of Switzerland

[73] Assignee: Scheuchzer S.A., Lausanne, Switzerland

[21] Appl. No.: 620,653

[22] Filed: Mar. 22, 1996

[30] Foreign Application Priority Data

Mar. 24, 1995 [EP] European Pat. Off. ..... 95810200

[51] Int. Cl.[6] ..... E01B 9/02

[52] U.S. Cl. ..... 104/2; 104/17.1

[58] Field of Search ..... 104/2, 17.1, 17.2; 33/1 Q; 73/146; 81/54, 57.41

[56] References Cited

U.S. PATENT DOCUMENTS 3,628,461 12/1971 Plasser et al. ..... 104/17.1

5,465,667 11/1995 Hosking et al. ..... 104/17.1

FOREIGN PATENT DOCUMENTS

| | | | |
|---|---|---|---|
| 2072853 | 9/1971 | France . | |
| 2666358 | 3/1992 | France . | |
| 2682135 | 4/1993 | France | 104/17.2 |
| 1193201 | 11/1985 | U.S.S.R. | 104/17.2 |
| 1289945 | 2/1987 | U.S.S.R. | 104/17.2 |
| 1696636 | 12/1991 | U.S.S.R. | 104/17.2 |
| 1735475 | 5/1992 | U.S.S.R. | 107/17.2 |

*Primary Examiner*—S. Joseph Morano
*Attorney, Agent, or Firm*—Skjerven, Morrill, MacPherson, Franklin & Friel

[57] ABSTRACT

A process and vehicle for automatically screwing and unscrewing tie screws performed by the vehicle moving continuously along a track. This invention makes it possible to detect and determine the relative position of a tie screw with respect to a tie screw fastening head by optoelectronic devices and to set, if appropriate, the inclination of the tie screw fastening head. The tie screw fastening head is positioned above the tie screw and a tie screw fastening cycle is engaged for each tie screw. The tie screw fastening heads then hop from one work position to another, performing this process.

11 Claims, 4 Drawing Sheets

ΔY1
Y1
Y2
Z
X
Y

X0
XM
ΔXi
XD
AM
1
2
3
4
5
6
7
8
9
10
11
12
13
14
15
16
16b
16c
17
18
19
20
21
24
26
X i-3
X i-2
X i-1
X i
X i+1

PROCESS FOR SCREWING AND UNSCREWING THE TIE SCREWS OF A RAILROAD AND MACHINE FOR IMPLEMENTING THE PROCESS

FIELD OF THE INVENTION

The present invention relates to a process for screwing and unscrewing the tie screws of a railroad according to which a vehicle advancing along the track and carrying tie screw detection devices and tie screw fastening heads is used, as well as a machine for implementing the process.

PRIOR ART

When laying or lifting the rails of a railroad, individual lightweight tie screw fasteners, each worked by an operator, are usually used. It therefore requires four people to screw or unscrew the four screws of a tie at a relatively fast rate of 200 to 250 meters an hour.

This is the only currently known manual means which can accurately position a tie screw fastening head on the head of a tie screw. Often, the latter head is not in its theoretical location, either because the tie is not parallel to the others, or because the tie is on a bend, or because the tie has been badly aligned or for any other reason. The tie screw may also be sunken obliquely instead of lying in a plane perpendicular to that of the axis of the tie.

Machines worked by a single operator are proposed in the documents FR-A-2 682 135 and FR-A-2 666 358. The machines described in these documents employ two double tie screw fastening heads to act simultaneously on the four tie screws of a tie, one double head acting per stretch of rail.

In the document FR-A-2 682 135, the four heads are lowered simultaneously, after positioning them with respect to the four tie screws, detection of the nuts being carried out by mechanical feelers. In the document FR-A-2 666 358, provision is made for the individual lowering of each of the heads and also for the possibility of a beam supporting the double heads being able to pivot with respect to an axis perpendicular to the plane of the track so as to stand parallel to an oblique tie. No provision is made for the prior detection of the nuts other than that performed visually by the operator.

The placement of the tie screw fastening heads and the engaging of the operations are carried out by an operator located behind the two double tie screw fastening heads.

These devices make it possible, obviously, to improve the working conditions since instead of four people, a single person is employed to operate the machine. Nevertheless, the positioning of the tie screw fastening heads with respect to the tie screws is done either by rudimentary mechanical feelers or visually by the operator. It follows that the accuracy of positioning the tools with respect to the tie screws and the speed of operation depend above all on the skill and experience of the operator. The possibilities for adjustment are limited, or even nonexistent, were it not for the inclined tie screws.

SUMMARY OF THE INVENTION

The purpose of the invention is to propose a process and a machine making it possible to remedy the drawbacks of the prior art and to ensure high-quality work at a high rate.

The advantages of the process according to the invention are:

the fact that the exact relative position of the tie screws with respect to the screwing means is determined preferably with a contactless sensor makes it possible subsequently to position each tie screw fastening head individually exactly with respect to the tie screw, the fact that each head can be inclined individually with respect to the plane of the track enables it to be adapted to a possible oblique position of a tie screw, the fact that each head can be moved and engaged individually makes it possible to deal with each tie screw individually, thus dividing by four, or even eight, the "failure" rate and preventing the concrete ties from cracking, the fact that all these operations are carried out in a purely automatic manner without any human intervention, by reliable technical means requiring no unreasonable financial investment, allows economies in staff expenses, who are freed from thankless repetitive tasks, and ensures optimal accuracy of the tie screw tightening torque.

Not only are the labor costs eliminated, but the operations for positioning the tools with respect to the tie screws are performed accurately and rapidly, without depending on a person's skill and speed of operation.

The relative position of a tie- screw with respect to the corresponding tie screw fastening head is determined according to the following steps:

a. an orthogonal reference base XYZ is defined, X being parallel to the axis of the rail, Y parallel to the tie and Z perpendicular to the XY plane, b. the position of the truck on the track is measured continually with respect to the orthogonal reference base, c. the relative position of each of the tie screw fastening heads is measured continually with respect to the truck, d. the position of each tie screw is detected and calculated with respect to the reference base and, e. the deviation of each tie screw with respect to the corresponding tie screw fastening head is calculated.

Preferably, the various measured positions are recorded along the way to allow an improvement in the work rate of the vehicle. Thus, It is unnecessary to wait for the end of a work cycle in order to measure the positions of the tie screws which will be dealt with subsequently.

When the calculated deviations in position are equal to zero, the tie screw fastening cycle of the head in question is engaged automatically.

The invention also relates to a machine for implementing the process according to the invention.

The machine comprises a vehicle furnished with means so that it can move along the track, and means for detecting and determining the relative position of a tie screw with respect to a tie screw fastening head, one module per stretch of rails, equipped with at least one tie screw fastening head, said module being designed so as to be movable with respect to the truck in the direction of the axis of the stretch of rail, said tie screw fastening head being furnished with means for being moved parallel to the axis of the stretch of rail, parallel to the tie, perpendicular to the plane defined by the two preceding directions and angularly with respect to this third direction, and automatic means individually engaging a tie screw fastening cycle for each head.

With the process according to the invention and the machine for implementing same, the applicant has obtained a rate of 400 meters an hour.

BRIEF DESCRIPTION OF THE DRAWINGS

The invention will be described in greater detail with the aid of the appended drawing.

DESCRIPTION OF THE PREFERRED EMBODIMENT

Figures 1, 2:
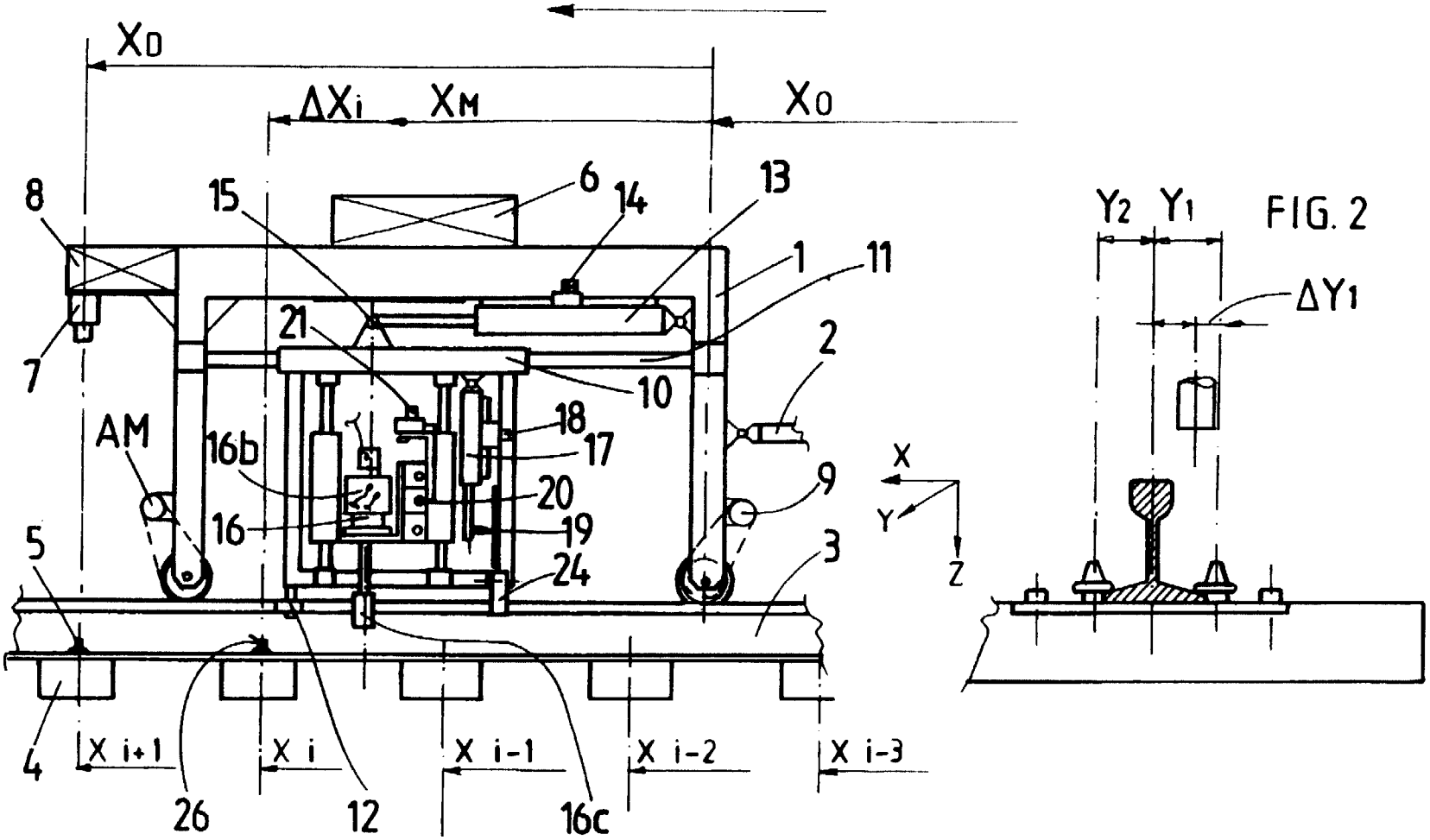
FIG. 1 is a diagrammatic view of the truck seen from the side.
FIG. 2 is a transverse partially sectioned view of a rail on a tie.
Figure 3:
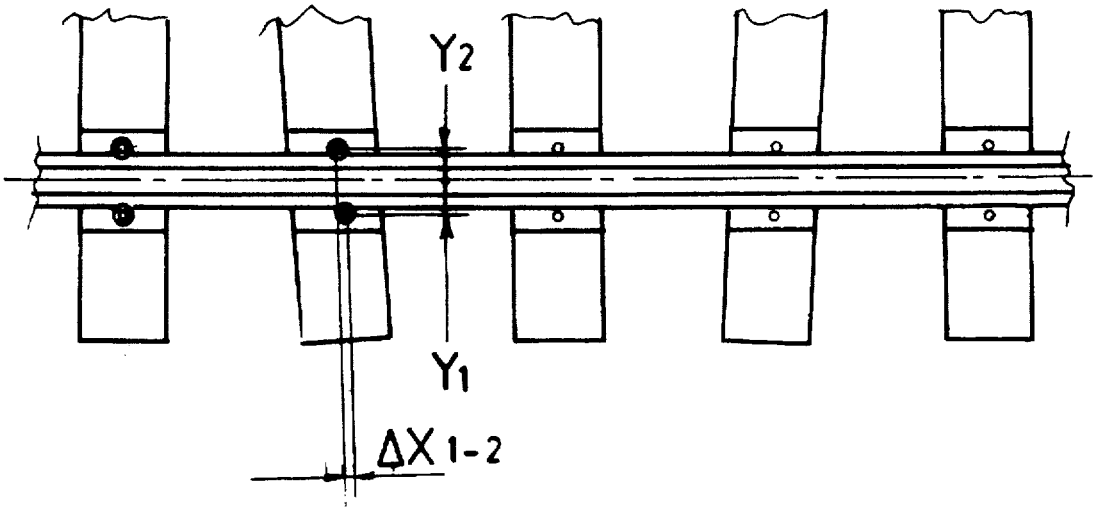
FIG. 3 is a plan view of a rail on ties.

The truck 1 depicted in FIG. 1 is furnished with a drawbar 2 by which it is connected to a machine providing for the locomotion of the truck. The truck moves on the rail 3 fixed to the ties 4 by means of tie screws 5, 26. The truck could be furnished with self-contained means of movement.

Figure 5:
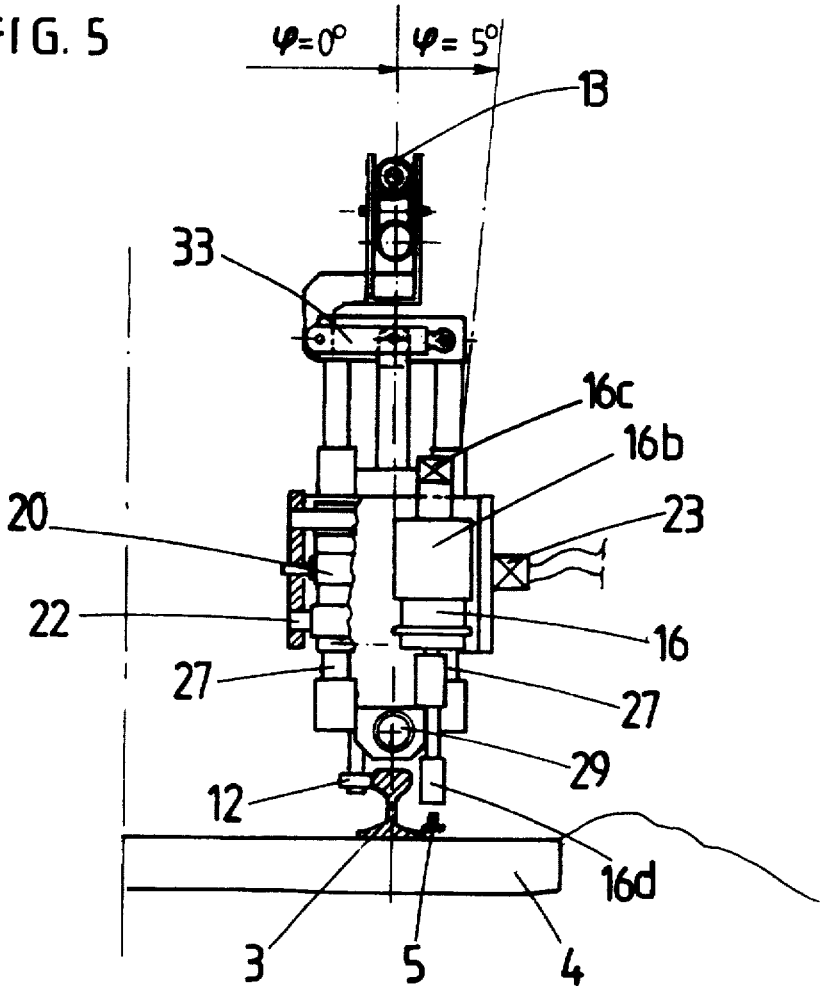
FIG. 5 is a transverse sectional view showing a double tie screw fastening head from the working position.

The truck 1 is furnished with a unit 6 providing for both the hydraulic and electrical power supply. An optoelectronic device 7 for detecting and measuring the position of the tie screws is arranged on the forward part of the truck. In principle, one such device is used per stretch of rails. The device 7 is connected to a box 8 for storing in memory and processing all the electronic data. A coder 9 arranged at the aft end of the truck gives the position $X_0$ of the truck on the rail 3 at any instant. The truck 1 is furnished on its upper part with a horizontal rod 11 secured to the truck 1 and on which slides a module 10 furnished on its lower part with two rollers 12 providing for its guidance with respect to the rail 3. The module 10 is moved along an axis X parallel to the axis of the rail by a jack 13 controlled by a servo valve 14. The position $X_M$ of the module 10 with respect to the truck 1 is indicated by a linear potentiometer 15. The module 10 carries two tie screw fastening heads 16, **16*a*, only one of which is visible in FIG. 1. Each head is furnished with a jack 17 actuated by a valve 18 for raising and lowering the tie screw fastening head. A linear coder 19 makes it possible to ascertain the height of the head at any moment. A double-acting jack 20 powered via a valve 21 provides for the transverse movement of the head 16 by making it slide on transverse guides 22 (FIG. 5). A coder 23 makes it possible to measure the transverse movement of the head (FIG. 5**).

Figure 4:
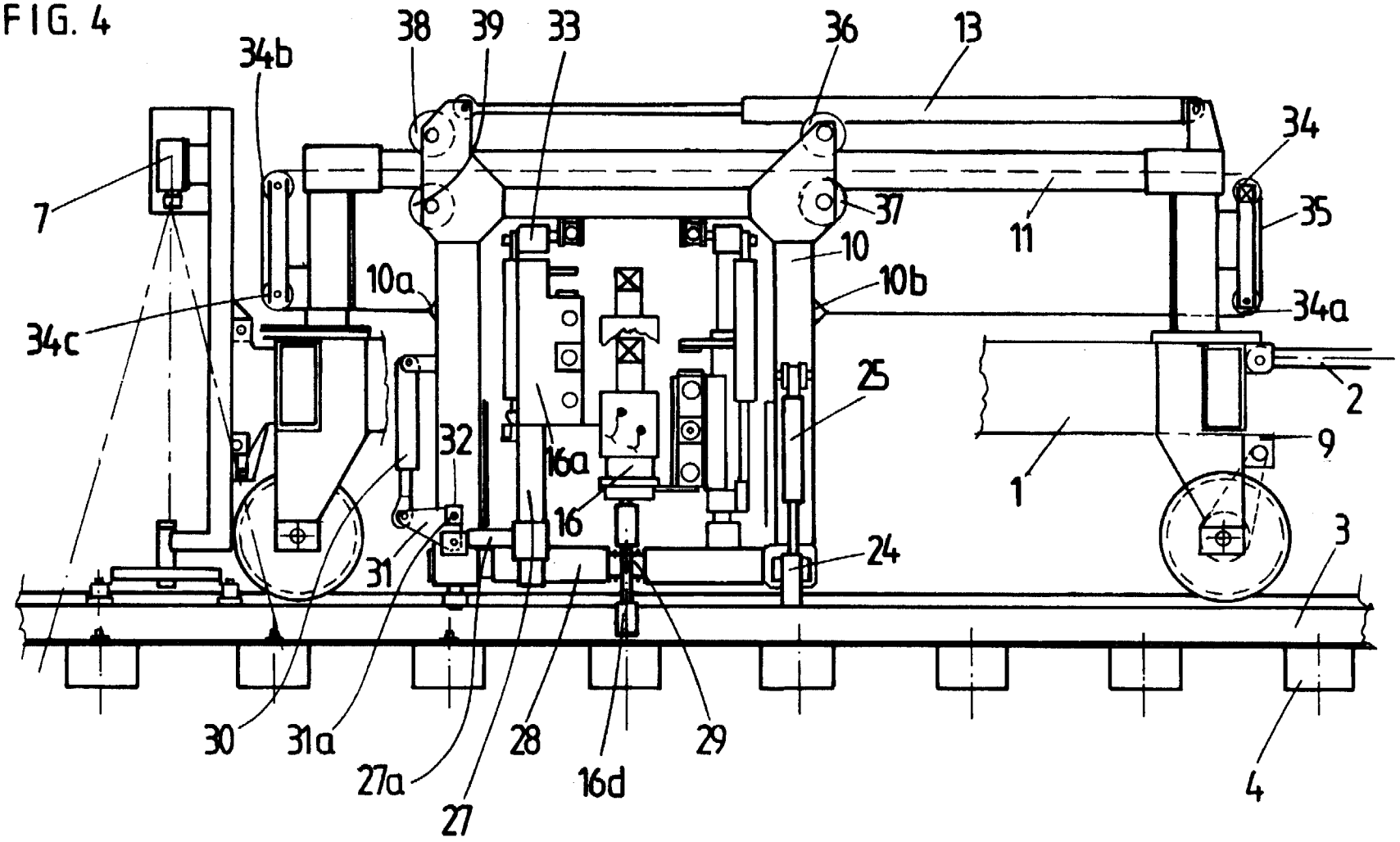
FIG. 4 is a side view of a truck more detailed than FIG. 1.

To enable the module 10 to be immobilized with respect to the rail 3, the module is furnished at its lower part with two clamps 24 actuated by jacks 25 (FIG. 4). Thus, when the tie screw fastening head 16 is above a tie screw 26 previously detected and located by the device 7, the clamps make it possible to immobilize the module with respect to the rail 3 so that the head 16 can unscrew the tie screw.

The device 7 is an optoelectronic device, for example a CCD (standing for Charge Coupled Device) camera with high resolution. One such camera is, in principle, used for each stretch of rails. In fact, the image captured by this camera is split into two parts, one part per tie screw. The position of each tie screw is thus captured in an XY plane (see the definition further on), thus enabling each tie screw fastening head to be guided individually.

The embodiment represented in FIG. 4 is more detailed. The truck 1 is likewise equipped with a module 10 furnished with two tie screw fastening heads 16 and **16*a*. The head 16*a* is represented in the top position and it is identical to the head 16. It is mounted on two guide columns 27 secured to a sleeve 28 sliding on a guide rod 29. A jack 30 controlled by a valve, not represented, acts on a linkage 31 formed by a triangular plate one of the vertices of which is secured to the end of the jack 30, another vertex being secured to a rod 27*a* secured to one of the guide columns 27 and the third furnished with a coder 32 being articulated about a pin 31*a* secured to the module 10**.

The heads 16 and **16*a* are independent of each other in regard to the direction of movement along three orthogonal axes X, Y, Z inside, obviously, the module 10**.

In order to allow inclination of the head 16 by an angle $\phi$ in order to tighten or loosen the oblique tie screws with respect to the ties, a jack 33 (FIG. 5) allows, through its extension, inclination of the head by pivoting about the guide rod 29. In FIG. 5 the tie screw fastening head 16 is represented in a position perpendicular to the tie 4, that is to say corresponding to an angle $\phi=0°$. This angle could vary by up to around 5° merely through the extension of the jack 33.

The potentiometer 15 of FIG. 1 making it possible to ascertain the movement of the module 10 has been replaced in FIG. 4 by a rotary coder 34 driven by a belt 35 whose two ends are fixed to two faces, fore and aft, of the module 10, in particular at the point **10*a* and 10*b*. Three idler rollers 34*a*, 34*b*, 34*c* allow for the movement of this notched belt during the movement of the module 10** inside the truck.

In FIG. 4, the module 10 is suspended from a tube 11 by two pairs of rollers 36, 37, 38, 39 which provide for the suspension and guidance of the module 10, its movement being effected by the jack 13. Each tie screw fastening head 16 comprises a hydraulic motor **16*b* with built-in reduction gearing, a counter 16*c* of the number of revolutions and a tool 16*d* (FIG. 5**).

The process according to the invention will now be described on the basis of this machine.

During the advance of the truck 1 along the rail 3, the detector 7 captures and stores in memory the exact position of each tie screw in the XY plane of an orthogonal reference base XYZ defined as follows: X is an axis parallel to the axis of the rail 3 and lying on the top of the rail, Y is an axis perpendicular to the previous one and parallel to the tie, and lying on the inside face of the rail, Z being perpendicular to the plane defined by the other two axes.

Thus, for a tie i, the coordinates of tie screws are the pairs $X_{1i}$ $Y_{1i}$, $X_{2i}$, $Y_{2i}$, $X_{3i}$ $Y_{3i}$, $X_{4i}$, $Y_{4i}$. The computer next calculates the differences $\Delta X$, $\Delta Y$ between the positions of tie screws and those of the corresponding heads along the two axes X and Y.

The servo-controlled jacks 13, 20 and 30 take each of the heads above the tie screws to be dealt with, for example the tie screw 26. In other words, the heads move until the differences $\Delta X$, $\Delta Y$ are zero. The jack 25 then closes the clamp 24 in order to immobilize the module 10 and the cycle for each tie screw fastening head begins, namely: lowering toward the tie screw, screwing and raising. Subsequently the module 10 is freed by loosening the clamp 24 and it moves toward the tie screws of the next tie.

Referring now to FIG. 1, the calculation of the differences $\Delta X$, $\Delta Y$ could be represented in greater detail. In fact, the position of the truck 1 and in particular its aft part (in the direction of movement during working) is $X_0$; the distance between this aft part of the truck and the position of the detector being XD, the absolute position of the tie screws of a tie detected by the detector 7 will be $X_i=X_{0i}+X_D$, $X_{0i}$ being the reference position of the truck for the tie i. In the same way, for the tie screw located at position i+1, we will have $X_{i+1}=X_0$ (i+1)+$X_D$ etc. The position of the module on the truck is $X_M$, hence the distance to be traveled by a tie screw fastening head in order to reach the position $X_i$ is equal to $\Delta X_i=X_i-(X_M+X_{0M})$, $X_{0M}$ being the position of the truck at the instant of the calculation. A hydraulic system which receives the calculation values allows the movement of the heads via the hydraulic valves powering control pistons (see FIG. 6).

The movements along Y and Z are simpler since it suffices to ascertain the positions $Y_i$ and $Z_i$ of the tie screws and $Y_M$ and $Z_M$ of the module and to zero the difference $Y_i-Y_M$ and $Z_i-Z_M$ when $\Delta X_i=0$.

The value of the angle $\phi$ is preset on the basis of visual observations prior to the work or in accordance with the data compiled when placing the track. Nevertheless, if for one reason or another one of the tie screws has been sunk at an angle which differs from the preset angle $\phi$, when the tool 16*d* tries to grasp the head of the tie screw, an autoadjustment of the angle $\phi$ is carried out about the preset position so that the tool 16*d* can grasp the tie screw without destroying it.

Figure 6:
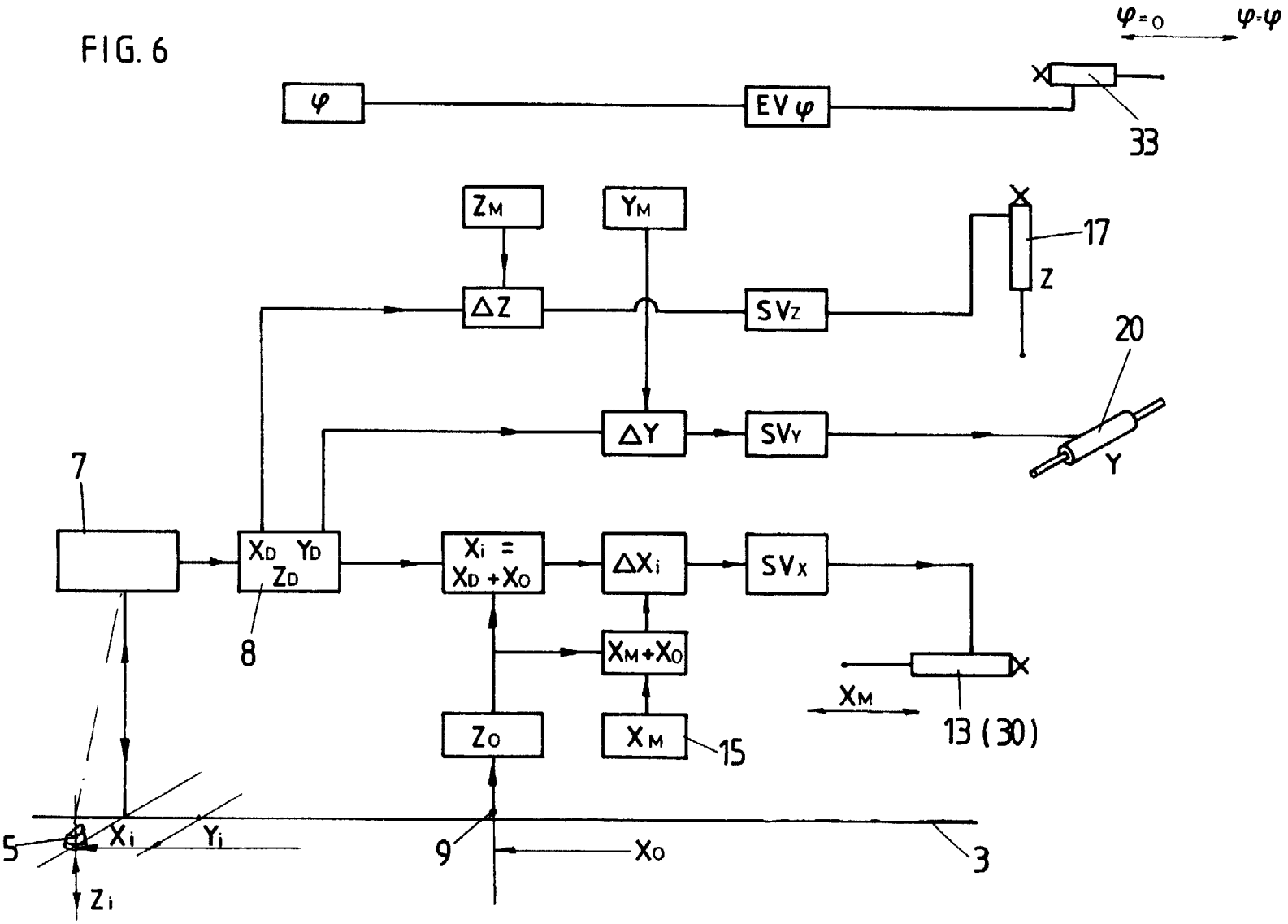
FIG. 6 is a block diagram of a device allowing control of the positioning of each tie screw fastening head.

In the block diagram of FIG. 6, we have represented a tie screw 5 arranged on one side of a stretch of rails 3 and whose absolute coordinates are $X_i$, $Y_i$, $Z_i$. The device 7 makes it possible to ascertain the detected coordinates $X_D$, $Y_D$, $Z_D$. The coder 9 indicates the position $X_0$ of the truck 1 and this makes it possible, firstly, to calculate the absolute coordinate $X_i=X_D+X_0$ of the tie screw. Subsequently, the potentiometer 15 indicates the longitudinal position $X_M$ of the truck, this making it possible to calculate the absolute position of the truck $X_M+X_0$ and to calculate the difference $\Delta X_i$. $\Delta X_i$ is the distance which the truck 1 has to travel so that the head is positioned above the tie screw 5 and which corresponds to a signal $SV_x$ to be sent to the electrovalve of 7 the jack 13 and possibly 30 in order to effect the X-wise movement of the module. In the same way, the value YD is transmitted to a computer which makes it possible to calculate the difference $\Delta Y_i$ given the module's position $Y_M$ which is known since it is always the same. A signal $SV_y$ corresponding to $\Delta Y_i$ can thus be sent to the electrovalve of the double-acting jack 20 in order to position the tie screw head along the Y axis.

Finally, the position $Z_D$ of the module which is likewise constant makes it possible to calculate the value $\Delta Z_i$ which corresponds to a signal $SV_z$ to be sent to the electrovalve of the jack 17 making it possible to lower the head to the height of the tie screw 5. Finally, if appropriate, the angle $\phi$ is introduced into a device, this making it possible to send a signal $EV_{100}$ to the electrovalve of the piston 33 in order to control the angular movement of the tie screw fastening head.

We claim:

1. A process for automatically screwing and unscrewing, a tie screw of a railroad according to which a vehicle advances continuously along a track and carries, a tie screw fastening head which can be moved with respect to said vehicle, as well as a tie screw detection device, wherein the relative position of the tie screw with respect to the tie screw fastening head is determined as follows:

a. an orthogonal reference base XYZ is defined, X being parallel to a rail, Y parallel to a tie and Z perpendicular to the XY plane;

b. the position of the vehicle on the track is measured continually with respect to the orthoqonal reference base;

c. the relative position of the tie screw fastening head is measured continually with respect to the vehicle;

d. the position of the tie screw is detected, calculated with respect to the orthogonal reference base and stored in memory;

e. the deviation in position between the tie screw and the tie screw fastening head is calculated continually.

2. The process as claimed in claim 1, wherein when the calculated deviations in position between the tie screw and the tie screw fastening head in the X and Y directions are equal to zero, a tie screw fastening cycle of the tie screw fastening head begins automatically.

3. The process as claimed in claim 2, wherein the tie screw fastening cycle comprises the following steps after the positioning of the tie screw fastening head above the tie screw:

a. longitudinal- locking of the tie screw fastening head with respect to the rail;

b. lowering of a tool toward the tie screw;

c. grasping of the tie screw With the tool;

d. rotating of the tool;

e. measurement of the torque applied by said tool;

f. automatic halting of the rotation of the tool when the torque reaches a predetermined value;

g. release of the tie screw and raising of the tool;

h. unlocking of the .tie screw fastening head from the rail.

4. A vehicle for automatically screwing and unscrewing a tie screw of a railroad, comprising:

means enabling said vehicle to move along a track;

means for detecting, determining and storing in memory the position of the tie screw, as well as means for continually calculating the deviation in position between the tie screw and a tie screw fastening head;

a module, equipped with the tie screw fastening head, said module being designed so as to be movable with respect to the vehicle in a direction parallel to a rail, said tie screw fastening head being furnished with means for being moved in an X direction parallel to the rail, in a Y direction parallel to a tie, in a Z direction perpendicular to a plane defined by the X and Y directions and angularly with respect to the Z direction.

5. The vehicle of claim 4, wherein said vehicle is furnished with means for automatically engaging a tie screw fastening cycle when the previously calculated deviations in position between the tie screw and the tie screw fastening head in the X and Y directions are equal to zero.

6. The vehicle of claim 5, wherein said vehicle is furnished with means for recording the position values of the vehicle, of the tie screw, and of the tie screw fastening head.

7. The vehicle of claim 4, wherein said vehicle is furnished with automotive means.

8. The vehicle of claim 4, wherein the tie screw fastening head is hydraulically or electrically operated.

9. The vehicle of claim 4, wherein the means for detecting the tie screw comprises an optoelectronic device.

10. The vehicle of claim 4, wherein the tie screw fastening head comprises.

11. The vehicle of claim 4 wherein the module is equipped with a plurality of tie screw fastening heads.

* * * * *

UNITED STATES PATENT AND TRADEMARK OFFICE
CERTIFICATE OF CORRECTION

PATENT NO. : 5,615,616
DATED : April 1, 1997
INVENTORS : Antoine SCHEUCHZER; Gerard SCHELLING; Christian WENGER; and Gerard SAUTEREL

It is certified that error appears in the above-identified patent and that said Letters Patent is hereby corrected as shown below:

Column 6, Line 62, delete "comprises." and insert --comprises:

means for positioning the tie screw fastening head with respect to the tie screw;

means for locking the tie screw fastening head with respect to a rail;

means for the lowering of a tool;

means for rotating said tool;

means for measuring a tightening or loosening torque applied by said tool;

UNITED STATES PATENT AND TRADEMARK OFFICE

CERTIFICATE OF CORRECTION

PATENT NO. : 5,615,616

DATED : April 1, 1997

INVENTOR(S) : Antoine SCHEUCHZER; Gerard SCHELLING; Christian WENGER; and Gerard SAUTEREL

It is certified that error appears in the above-indentified patent and that said Letters Patent is hereby corrected as shown below:

means for automatically halting rotation of said tool when the torque reaches a predetermined value; and means for releasing the tool from the tie screw.--

Signed and Sealed this

Thirtieth Day of September, 1997

*Attest:*

Bruce Lehman

BRUCE LEHMAN

*Attesting Officer*

*Commissioner of Patents and Trademarks*